United States Patent [19]

Haertl et al.

[11] Patent Number: 4,763,752

[45] Date of Patent: Aug. 16, 1988

[54] MOUNT FOR A SOUND TRANSDUCER, PARTICULARLY AN EARPHONE

[75] Inventors: Christof Haertl, Neunkirchen; Peter Nassler, Eckental, both of Fed. Rep. of Germany

[73] Assignee: Siemens Aktiengesellschaft, Berlin and Munich, Fed. Rep. of Germany

[21] Appl. No.: 48,893

[22] Filed: May 12, 1987

[30] Foreign Application Priority Data

May 16, 1986 [DE] Fed. Rep. of Germany ..... 3616546

[51] Int. Cl.[4] ..... H04R 25/00

[52] U.S. Cl. ..... 181/130; 181/135; 381/68.6; 381/69; 381/169; 381/205

[58] Field of Search ..... 181/130, 135; 381/68.6, 381/69, 169, 188, 205

[56] References Cited

U.S. PATENT DOCUMENTS

| | | | |
|---|---|---|---|
| 3,448,224 | 6/1969 | Gillen | 381/68.6 |
| 3,812,300 | 5/1974 | Brander et al. | 381/69 |
| 4,069,400 | 1/1978 | Johanson et al. | 381/68.6 |

FOREIGN PATENT DOCUMENTS

| | | |
|---|---|---|
| 1222116 | 4/1966 | Fed. Rep. of Germany . |
| WO85/03185 | 7/1985 | PCT Int'l Appl. . |
| 539375 | 8/1973 | Switzerland . |
| 648172 | 2/1985 | Switzerland . |

*Primary Examiner*—B. R. Fuller

*Attorney, Agent, or Firm*—Hill, Van Santen, Steadman et al.

[57] ABSTRACT

A sound transducer, particularly an earphone, is buttoned into a sound opening of an in-the-ear hearing aid housing by means of an elastic hose part seated on a sound connector of the sound transducer. The elastic hose part is slightly pre-stressed in longitudinal direction and the sound transducer is provided with an elastic abutment that elastically compensates the prestress.

9 Claims, 1 Drawing Sheet

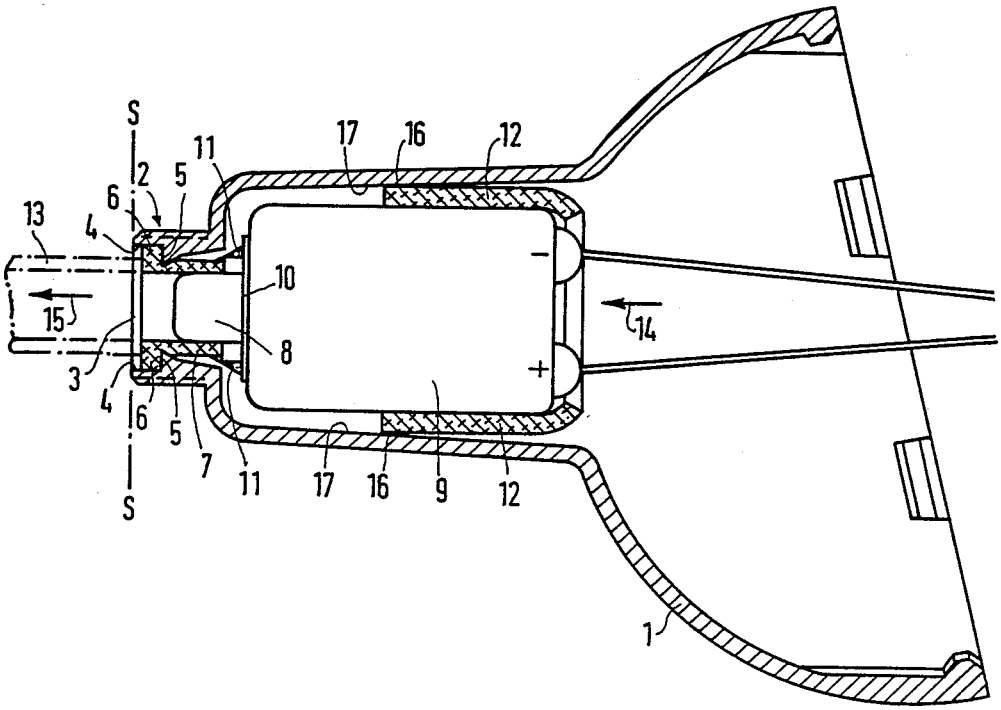
S
2
5
11
17
16
12
6
13
4
10
15
8
3
4
6
5
7
11
17
16
9
12
S
14
1

MOUNT FOR A SOUND TRANSDUCER, PARTICULARLY AN EARPHONE

BACKGROUND OF THE INVENTION

1. Field of the Invention

The invention is directed to a mount for a sound transducer, particularly an earphone, having a sound connector in a housing of a hearing aid, particularly an in-the-ear hearing aid, close to the allocated sound opening, whereby the sound transducer is buttoned into the sound opening by means of an elastic hose part seated on the sound connector and is also at least partially provided with an elastic support.

2. Description of the Prior Art

In the known mounts, the sound transducer has its sound connector glued into the sound opening of the housing of the hearing aid. This can lead to undesired acoustical feedbacks. The adhesive can also partially glue the sound opening shut, so that the sound can no longer emerge unimpeded.

However, elastic hose mounts are also already known (for example, Swiss Patent No. 539 375, Swiss Patent No. 648 172, Australian Published Application No. 85.03 185, U.S. Pat. No. 4,069,400 and German Application No. 12 22 116). For example, Swiss Patent No. 539 375 discloses a mount of the type described above wherein an earphone or, respectively, a microphone of a hearing aid as sound transducer is inserted, on the one hand, in the appertaining sound line by means of an elastic hose part which is pre-stressed for pressure and, on the other hand, the respective sound transducer is at least partially seated in a pocket having elastic supporting nubs. Unfortunately, however, the pressure can lead to undesired dislocations of the mounted sound transducer in the hearing aid housing and these can only be countered when the appertaining sound transducer is additionally inserted into a housing compartment that limits the movement.

SUMMARY OF THE INVENTION

An object of the present invention is to provide a mount that does not exhibit the above described disadvantage.

This object is inventively achieved by providing that the elastic hose part is slightly elastically pre-stressed in longitudinal direction such that it pulls the sound transducer in the direction of the sound opening and the sound transducer is provided with the elastic support as an elastic tension abutment. Preferably the elastic hose part and the sound opening are buttoned to one another by means of a bead-channel connection. That is, the elastic hose part embraces an annular bead that can be buttoned into an annular channel of the sound opening that mates therewith. Preferably the annular channel is proximally open and only the distal, annular lateral face thereof forms an abutment for the elastic hose part that is prestressed in longitudinal direction.

In accord with the invention, the sound transducer is inserted between the sound opening and the housing in a fully elastically tension-producing fashion. It is thus firmly seated (not irreversibly displaceable) and, accordingly, is seated elastically in the mount. An accessible housing compartment that wastes space is no longer needed. The inside wall of the hearing aid housing can be directly employed as the supporting wall.

BRIEF DESCRIPTION OF THE DRAWINGS

Further advantages and details of the invention derive from the following description of an exemplary embodiment with reference to a FIGURE.

The FIGURE shows an in-the-ear hearing aid module comprising an earphone mount of the invention shown in a partial longitudinal section.

DESCRIPTION OF THE PREFERRED EMBODIMENTS

In the FIGURE, a housing 1 of an in-the-ear hearing aid module has its proximal end embracing a sound outlet opening 3 fashioned in the form of a connector or neck. A proximally open annular channel 4 is formed in the sound outlet opening 3.

An annular lateral face 5 of the annular channel 4 is an abutment for an annular bead 6 of an elastic hose part 7 (of, for example, high-temperature crosslinking caoutchouc).

The elastic hose part 7 has its end facing away from the bead 6 seated on a sound discharge connector 8 of an earphone 9 and is glued to the earphone 9 with adhesive 11 at an end 10 at the earphone side (for example, with a silicone adhesive).

About half of the earphone 9 is also embedded in a pocket 12 of elastic plastic of, for example, high-temperature crosslinking caoutchouc.

The assembly and subsequent mounting of the earphone 9 derives in the following way. During assembly, the elastic hose part 7 is part of a hose that is indicated with broken lines and referenced 13 in the FIGURE. By means of the hose pulled over the sound discharge opening 8 and glued, the earphone 9 is threaded into the sound outlet opening 3 of the housing of the hearing aid module in the direction of the arrow 14. The earphone 9 can then be pressed into the position shown in the FIGURE, so that the bead 6 of the hose 13 snaps in behind the annular lateral face 5 of the annular channel 4.

Subsequently, the hose 13 is also stretched somewhat in the direction of the arrow 15, so that the bead 6 is pulled out of the sound outlet opening 3.

In this position, the pulled-out end of the hose 13 is cut off directly in front of the bead (indicated in the FIGURE by the section plane S—S).

The only thing now remaining is the elastic hose part 7 which, after the stretching has ceased, contracts again. The earphone 9 is thus elastically held in the sound outlet opening 3 by the bead 6 of the elastic hose part 7 in interaction with the elastic pocket 12 which presses resiliently against the inside wall of the housing of the hearing aid module in an annular punctiform fashion at points 16.

Acoustic feedbacks are avoided. The sound outlet opening is always open.

The hearing aid microphone (not shown) can be held in a similar way as needed.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A mount for a sound transducer, particularly an earphone, having a sound connector in a housing of a hearing aid having a sound opening, particularly an in-the-ear hearing aid, close to the sound opening, whereby the sound transducer is buttoned into the sound opening by means of an elastic hose part seated on the sound connector and is also at least partially provided with an elastic support, comprising the improvement wherein the elastic hose part is slightly elastically stretched in longitudinal direction such that it pulls the sound transducer in the direction of the sound opening and the sound transducer is provided with the elastic support as an elastic tension abutment.

2. A mount according to claim 1, wherein the elastic hose part and the sound opening are buttoned to one another by means of a bead-channel connection.

3. A mount according to claim 2, wherein the elastic hose part embraces an annular bead that can be buttoned into an annular channel of the sound opening that mates therewith.

4. A mount according to claim 3, wherein the annular channel has a distal, annular lateral face, the channel being proximally open, and only the distal, annular lateral face thereof forms an abutment for the elastic hose part that is stretched in the longitudinal direction.

5. A mount according to claim 1, wherein the hose part at least partially projects beyond or over the sound connector of the sound transducer and has its projecting part buttoned into the sound opening.

6. A mount according to claim 1, wherein the elastic hose part is glued to the sound transducer.

7. A mount according to claim 1, wherein the sound transducer is at least partially seated in a pocket of elastic material that contacts the inside wall of the housing of the hearing aid in at least punctiform fashion and thus forms the tension abutment.

8. A mount according to claim 7, wherein the pocket approximately covers that half of the sound transducer opposite the sound connector.

9. A mount according to claim 1, wherein the sound opening likewise comprises a connector or neck form and the sound transducer is buttoned into this connector by means of the elastic hose part.

* * * * *